US010206499B2

(12) United States Patent
Purifoy

(10) Patent No.: US 10,206,499 B2
(45) Date of Patent: Feb. 19, 2019

(54) MULTIPURPOSE DESK WITH AN INTEGRATED COMPUTER SYSTEM

(71) Applicant: Albert A Purifoy, Phoenix, AZ (US)

(72) Inventor: Albert A Purifoy, Phoenix, AZ (US)

( * ) Notice: Subject to any disclaimer, the term of this patent is extended or adjusted under 35 U.S.C. 154(b) by 0 days.

(21) Appl. No.: 15/640,178

(22) Filed: Jun. 30, 2017

(65) Prior Publication Data

US 2018/0020824 A1 Jan. 25, 2018

Related U.S. Application Data

(60) Provisional application No. 62/365,056, filed on Jul. 21, 2016.

(51) Int. Cl.

| | |
|---|---|
| ***A47B 21/03*** | (2006.01) |
| ***A47B 21/04*** | (2006.01) |
| ***A47B 97/00*** | (2006.01) |
| ***F41H 5/24*** | (2006.01) |
| *F41H 5/08* | (2006.01) |

(52) U.S. Cl.

CPC ..... *A47B 21/0314* (2013.01); *A47B 21/04* (2013.01); *A47B 97/00* (2013.01); *F41H 5/24* (2013.01); *A47B 2200/0073* (2013.01); *A47B 2200/0077* (2013.01); *A47B 2200/0081* (2013.01); *F41H 5/08* (2013.01)

(58) Field of Classification Search

CPC ..... A47B 21/0314; A47B 21/04; A47B 97/00; A47B 2200/0073; A47B 2200/0077; A47B 2200/0081; F41H 5/24

See application file for complete search history.

(56) References Cited

U.S. PATENT DOCUMENTS 1,159,859 A * 11/1915 Murphy ..... E06B 9/0638 160/127
2,341,914 A * 2/1944 Fleischman ..... A47B 17/04 312/194
4,108,517 A * 8/1978 Tomalinas, Jr. ..... A47B 17/006 312/139.2
4,279,454 A * 7/1981 Koiso ..... E06B 9/115 160/196.1
4,766,422 A * 8/1988 Wolters ..... A47B 21/0073 248/694
5,121,974 A * 6/1992 Monson ..... A47B 21/00 160/113
5,678,905 A * 10/1997 Kelley ..... A47B 21/00 312/196

(Continued)

*Primary Examiner* — Hanh V Tran

(57) ABSTRACT

A multipurpose with an integrated computer system uses a desk and a drawer computer to provide a user with enhanced safety for themselves and their data. The desk has a support structure, a tabletop, an antiballistic shell, a concealment cavity, a computer enclosure, and a storage compartment. The support structure is a rigid frame onto which the tabletop is mounted. The antiballistic shell is a protective layer of material that wraps around the lateral surface of the support structure so that bullets and flying debris cannot harm the user or the drawer computer. The concealment enclosure is a cavity within the desk that functions as a personal bunker into which the user can crawl. The drawer computer is a personal computing device that is mounted within the computer enclosure. Finally, the storage compartment is a drawer or cabinet that can be used for storing personal items.

12 Claims, 6 Drawing Sheets

(56) References Cited

U.S. PATENT DOCUMENTS

| | | | | | |
|---|---|---|---|---|---|
| 5,975,657 | A * | 11/1999 | LaCour | A47B 83/001 | 312/196 |
| 6,022,087 | A * | 2/2000 | Gilbert | A47B 21/00 | 312/194 |
| 6,033,045 | A * | 3/2000 | Roberts | A47B 21/007 | 108/50.01 |
| 6,155,180 | A * | 12/2000 | Clark | A47B 21/06 | 108/26 |
| 6,158,829 | A * | 12/2000 | Nielsen | A47B 46/00 | 312/208.1 |
| 6,170,379 | B1 * | 1/2001 | Taylor | F41H 5/08 | 312/196 |
| 6,193,338 | B1 * | 2/2001 | Kocer | A47B 13/10 | 312/194 |
| 8,027,155 | B2 * | 9/2011 | Bae | A47B 21/00 | 312/223.3 |
| 8,701,544 | B2 * | 4/2014 | Peters | F41H 5/06 | 89/36.01 |
| 2007/0170826 | A1 * | 7/2007 | Tsao | A47B 21/00 | 312/223.3 |
| 2016/0003583 | A1 * | 1/2016 | Harwood | F41H 5/08 | 89/36.09 |

* cited by examiner

MULTIPURPOSE DESK WITH AN INTEGRATED COMPUTER SYSTEM

The current application claims a priority to the U.S. Provisional Patent application Ser. No. 62/365,056 filed on Jul. 26, 2016.

FIELD OF THE INVENTION

The present invention relates generally to a computer system. More specifically, the present invention relates to a multipurpose workstation that is designed to securely protect a user and vital internal electronic components in extreme external conditions.

BACKGROUND OF THE INVENTION

The present invention is intended to provide real security for all of the desktop electronic equipment, including laptops, desktops, tablets, Smartphone, telephones, printers, fax machines, and scanners. The present invention denies all physical and unauthorized access to these components. The present invention can protect the equipment from fire, water damage, theft, vandalism, riots gunfire and worse. Current desktop equipment takes up needed surface space. The present invention takes up 0% of the work surface, even while it is in use. There is a lack of individuality in the appearance of the high-tech devices. The present invention, like automobiles, can be ordered to fit the taste and style of the end-user. Some end-users face real threats, in their homes, offices, businesses, military post, HQ's, embassies, etc. The present invention can provide a last ditch opportunity to save the life of the end-user with a personal bunker feature. What if you can't decide which device is best for you? How does one choose the right product when their needs are constantly changing? And why should they have to choose which type of device they need, when you can have it all? The present invention allows the end-user to create their perfect system.

How the Invention Works to Accomplish its Objective

The present invention provides real security with a layered chassis, wrapped in a protective container, placed in a lockable enclosure. The entire system is designed to replace the top left or right drawer of desk, table, or other work surface. When needed, a platform slides out, exposing only the monitor, keyboard, disk drives, USB ports and other plug-in requirements. The rest is the system remains locked out of sight and secured. The present invention allows the end-user to select their device, based on their individual taste, style and requirements. The present invention is designed to blend into the environment. Some end-users face real threats, in their homes, offices, businesses, military post, HQ's, embassies, etc. The present invention provides an armored container for the end-user to crawl into and bring down an armored garage styled door. The door can only be opened from the inside.

DETAIL DESCRIPTIONS OF THE INVENTION

Figure 1:
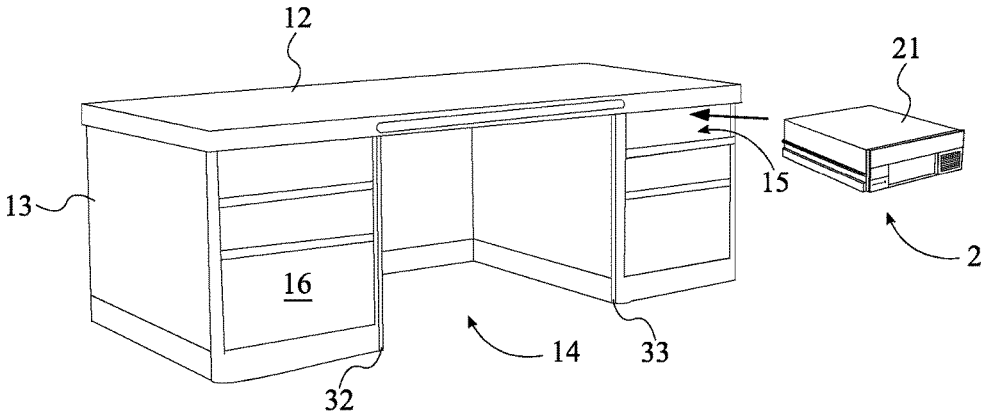
FIG. 1 is a perspective view of the present invention where the bold arrow indicates the direction which the drawer computer is inserted into the computer enclosure.

All illustrations of the drawings are for the purpose of describing selected versions of the present invention and are not intended to limit the scope of the present invention.

As can be seen in FIG. 1 through FIG. 12, the present invention, the multipurpose desk with an integrated computer system, is a desk incorporates electronic and personal safety devices into a highly-secured workstation. The present invention is designed as a desk that functions as a personal bunker for a user who is working in a high-stakes environment such as a war zone or a highly-classified government agency. In addition to functioning as a personal bunker, the present invention includes a computer workstation that can be locked away for security and to provide maximum working area on the desk. To accomplish this, the present invention comprises a desk 1, and a drawer computer 2. The desk 1 is preferably an office desk with dimensions that can be customized based on the user's preference. The desk 1 comprises a support structure 11, a tabletop 12, an antiballistic shell 13, a concealment cavity 14, a computer enclosure 15, and at least one storage compartment 16. The support structure 11 forms the structural foundation of the desk 1 and acts as the frame onto which the remaining pieces of the present invention are mounted. As such, the tabletop 12 is connected onto the support structure 11 so that the user is able to employ the desk 1 as a surface on which to rest items and perform tasks. The antiballistic shell 13 is a layer of material designed to stop projectiles and flying debris. Additionally, the antiballistic shell 13 is connected around a lateral surface of the support structure 11, adjacent to the tabletop 12. Consequently, the antiballistic shell 13 forms a protective liner that enables the present invention to protect the user while being used as a personal bunker. The concealment enclosure is an area within the desk 1 that the user can enter during an emergency. To that end, the concealment cavity 14 laterally traverses through the antiballistic shell 13 into the support structure 11, adjacent to the tabletop 12. This provides a cavity within the desk 1 that can be used as a personal bunker to protect the user in case of an emergency. While being designed to protect, the user, the desk 1 is also equipped with components that facilitate traditional office work. Specifically, the storage compartment 16 is designed as a drawer or a cabinet that is used to store documents and tools. As such, storage compartment 16 is integrated into the support structure 11, adjacent to the concealment cavity 14. The present invention is preferably designed with multiple storage compartments 16. The present invention is designed with a computer enclosure 15 that is a receptacle for the drawer computer 2, yet resembles the storage compartment 16. Furthermore, the computer enclosure 15 is integrated into the support structure 11, adjacent to the concealment cavity 14. Moreover, the storage compartment 16 and the computer enclosure 15 are positioned opposite to each other about the concealment cavity 14. Thus positioned, the computer enclosure 15 forms a compartment into which the drawer computer 2 can be stored. Additionally, accessing the computer enclosure 15 does not hinder accessing the storage compartment 16. The drawer computer 2 is a complete computer system that is designed to fit into a desk drawer. The drawer computer 2 is slidably mounted within the computer enclosure 15. Consequently, the user is able to pull the drawer computer 2 out of computer enclosure 15 when needed. Otherwise, the user is able to push the drawer computer 2 into the computer enclosure 15 for storage. Additionally, the user is able to dismount the drawer computer 2 from the computer enclosure 15 and transport the drawer computer 2 to a different desk. In the preferred embodiment of the present invention, the draw computer can be constructed to fit into desk drawers of varying shape and size.

Figure 2:
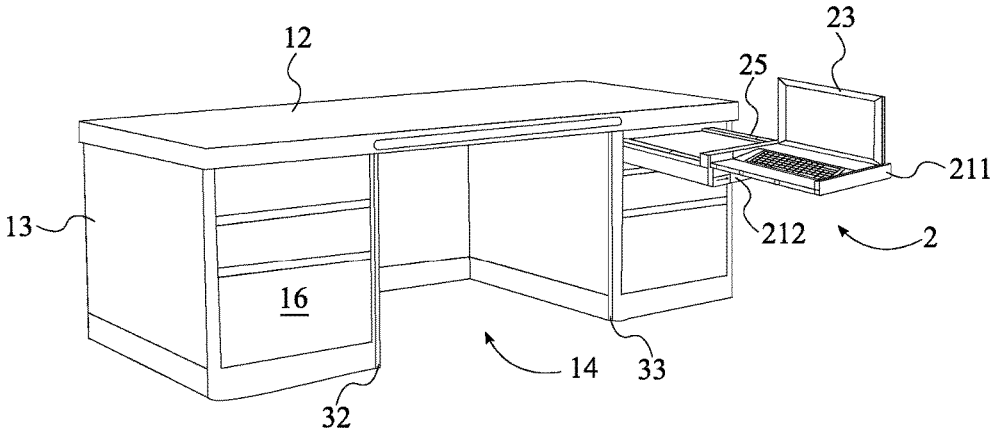
FIG. 2 is a perspective view of the present invention with the drawer computer deployed.
Figure 3:
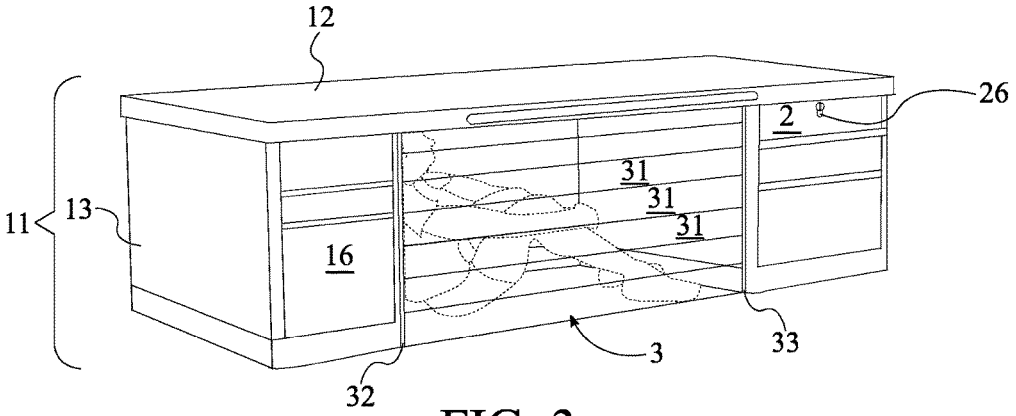
FIG. 3 is a perspective view of the present invention with a user inside of the personal bunker.

As can be seen in FIG. 1 through FIG. 3, the present invention is designed to form a personal bunker that conceals the user and protects the user from dangers in the external environment. To accomplish this, the present invention comprises a door 3. The door 3 is mounted across the concealment cavity 14 so that the user is able to isolate themselves from the external world within the concealment cavity 14. Additionally, the door 3 is preferably made from antiballistic material such as Kevlar or nylon. In the preferred embodiment of the present invention, the door 3 is a roll up door. The door 3 comprises a plurality of panes, a first track 32, and a second track 33. The first track 32 and the second track 33 are channels used to guide the roll up door 3 as the user opens or closes the concealment cavity 14. To accomplish this, the first track 32 is connected along the support structure 11, adjacent to an opening of the concealment cavity 14. Likewise, second track 33 is connected along the support structure 11, adjacent to an opening of the concealment cavity 14. Finally, the first track 32 and the second track 33 are positioned opposite to each other about the concealment cavity 14. Thus positioned, the first track 32 and the second track 33 form the raceways along which the plurality of slats 31 run. As such, each of the plurality of panes is slidably mounted between the first track 32 and the second track 33. Accordingly, the plurality of slats 31 can be moved from an opened configuration to a closed configuration by sliding the plurality of slats 31 along the first track 32 and the second track 33. To accomplish this functionality, each of the plurality of panes are serially coupled to each other. As a result, the roll up door 3 is able to be rolled up while in the opened configuration, yet still form a rigid barrier while in the closed configuration.

Figure 4:
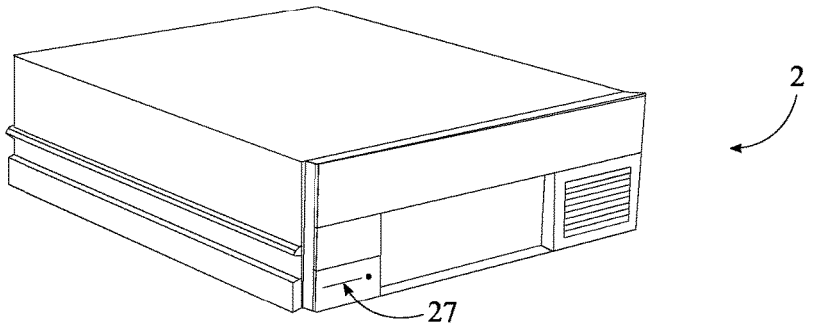
FIG. 4 is a perspective view of the drawer computer while not inserted into the desk.
Figure 5:
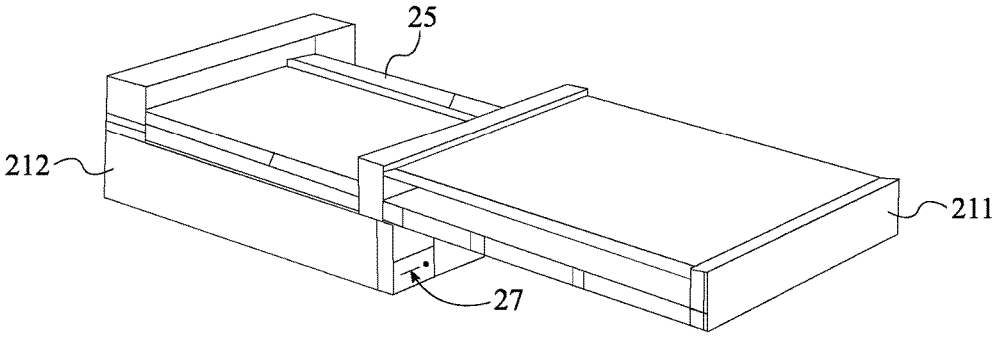
FIG. 5 is a perspective view of the drawer computer with the first tier extended past the second tier.
Figure 6:
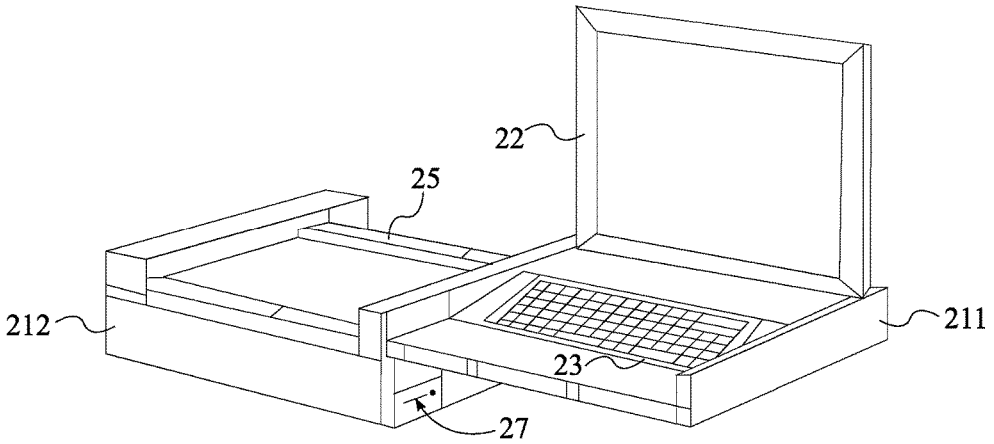
FIG. 6 is a perspective view of the drawer computer with the first tier extended past the second tier and the screen opened.

As can be seen in FIG. 4 through FIG. 6, the present invention is designed with a drawer computer 2 that functions as a complete desktop workstation and can be fully hidden away, yet does not consume any space on the table top when deployed. To accomplish this, the drawer computer 2 comprises a tiered housing 21, a screen 22, a keyboard 23, and a processing unit 24. The tiered housing 21 is a rigid enclosure that forms the structural foundation of the drawer computer 2. Accordingly, the screen 22 is hingedly connected to the tiered housing 21 so that the user can fold the screen 22 up to deploy the drawer computer 2 or fold the screen 22 down to store the drawer computer 2. The keyboard 23 is mounted onto the tiered housing 21 adjacent to the screen 22. Consequently, the keyboard 23 is places in a location that facilitates interacting with the drawer computer 2 without blocking the screen 22. The keyboard 23 preferably includes a trackpad that enables the user to interact with the drawer computer 2 without the use of an external mouse. The processing unit 24 is the collection of electronic components that enable the drawer computer 2 to function similarly to a personal computing device. The processing unit 24 is mounted within the tiered housing 21, offset from screen 22. Consequently, the processing unit 24 is isolated from the external environment and does not hinder the user from accessing the screen 22 or the keyboard 23. The processing unit 24 preferably contains electronic components including, but not limited to, a processor, a hard disk drive, an optical drive, a modem, and an audio input/output port. The screen 22 and the keyboard 23 are electronically connected to the processing unit 24 so that the keyboard 23 and the screen 22 are able to send data to and receive data from the processing unit 24.

As can be seen in FIG. 1 and FIG. 4 through FIG. 6, the present invention is designed with a drawer computer 2 that uses a tiered housing 21 which has levels that can be slid apart, thus increasing the tabletop 12 area that is available to the user. As such, the tiered housing 21 comprises a first tier 211 and a second tier 212. The first tier 211 is slidably mounted onto the second tier 212 so that the first titer can be slid into a position that enables the second tier 212 to act as a tabletop. The second tier 212 is slidably engaged into the computer enclosure 15. Consequently, the second tier 212 enables the drawer computer 2 to slide into and out of the computer enclosure 15 when being stored or deployed. In the present invention, the first tier 211 functions as a supporting structure on which the user interface devices of the drawer computer 2 are mounted. As such, the screen 22 is hingedly connected to the first tier 211. Additionally, the keyboard 23 is mounted onto the first tier 211, opposite to the second tier 212. Thus positioned, the keyboard 23 and the screen 22 are retained on orientations that facilitate user interaction.

As can be seen in FIG. 1 through FIG. 6, the second tier 212 is designed to function as an enclosure that houses the remaining electronic components of the drawer computer 2. To that end, the processing unit 24 is housed within the second tier 212 so that the processing unit 24 is protected from being damaged by water or being crushed. The present invention comprises a motor 25 that is integrated in between the tiered housing 21 and the computer enclosure 15, wherein the motor 25 is used to slide the tiered housing 21 into and out of the computer enclosure 15. Accordingly, the motor 25 enables the user to store or deploy the drawer computer 2 by simply pressing a button. Additionally, the present invention comprises a locking mechanism 26 that is operatively integrated in between the tiered housing 21 and the computer enclosure 15, wherein the locking mechanism 26 is used to secure the tiered housing 21 within the computer enclosure 15. The locking mechanism 26 can be any locking device including, but not limited to a latch, a lock, or an electronic keypad. The locking device enables the user to prevent unauthorized individuals from accessing the drawer computer 2. To enhance the functionality of the drawer computer 2, the present invention comprises at least one input/output (I/O) port 27. The I/O port 27 is an electronic terminal used to enable the user to connect external devices to the drawer computer 2. The I/O port 27 can be any number of electrical interconnect standards including, but not limited to, USB, HDMI, firewire, micro USB, or micro SD. As such, the I/O port 27 is integrated into an exterior surface of the tiered housing 21. Thus positioned, the I/O port 27 enables the user to readily connect peripheral devices to the drawer computer 2. Furthermore, the I/O port 27 is electronically connected to the processing unit 24. Accordingly, electronic devices that are connected to the I/O port 27 are placed in electronic communication with the processing unit 24. The present invention comprises a power supply 28 that is electrically connected to the processing unit 24, the screen 22, and the keyboard 23. As a result, the power supply 28 is able to provide the electrical power required to operate the drawer computer 2 and all of the remaining electronic components that are included in the present invention.

Figure 10:
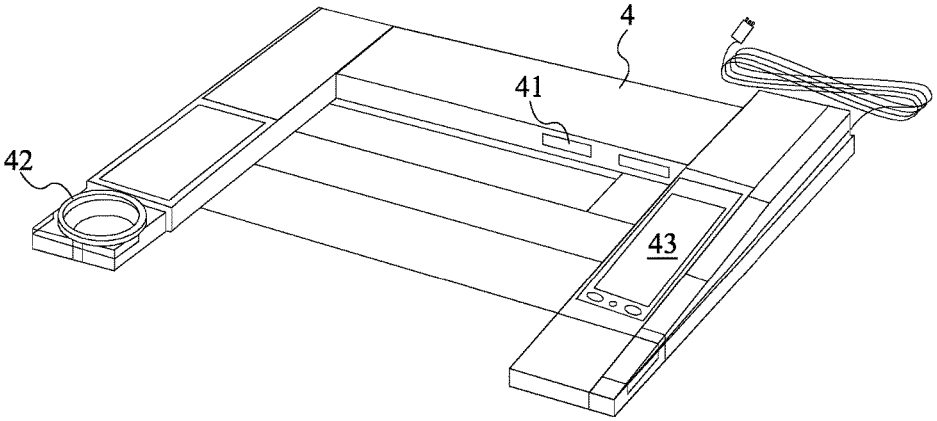
FIG. 10 is a perspective view of the computer dock.
Figure 11:
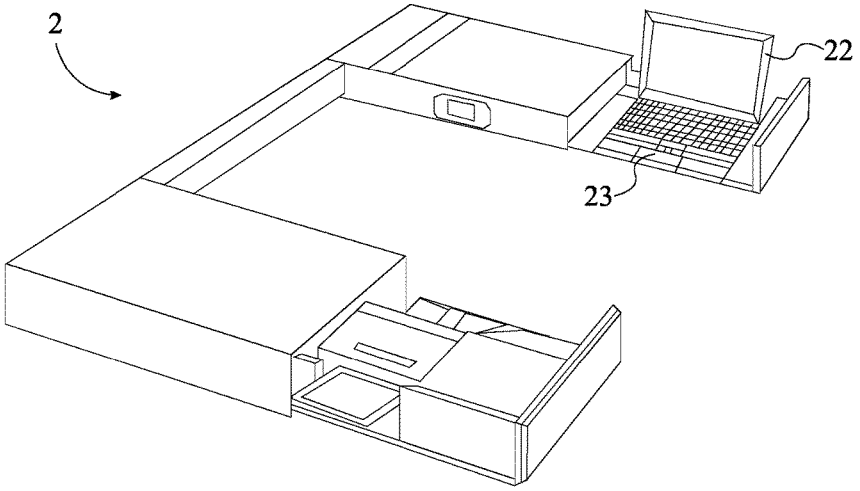
FIG. 11 is a perspective view an alternative embodiment of the desktop computer that has an integrated phone, fax machine, and Internet modem.
Figure 12:
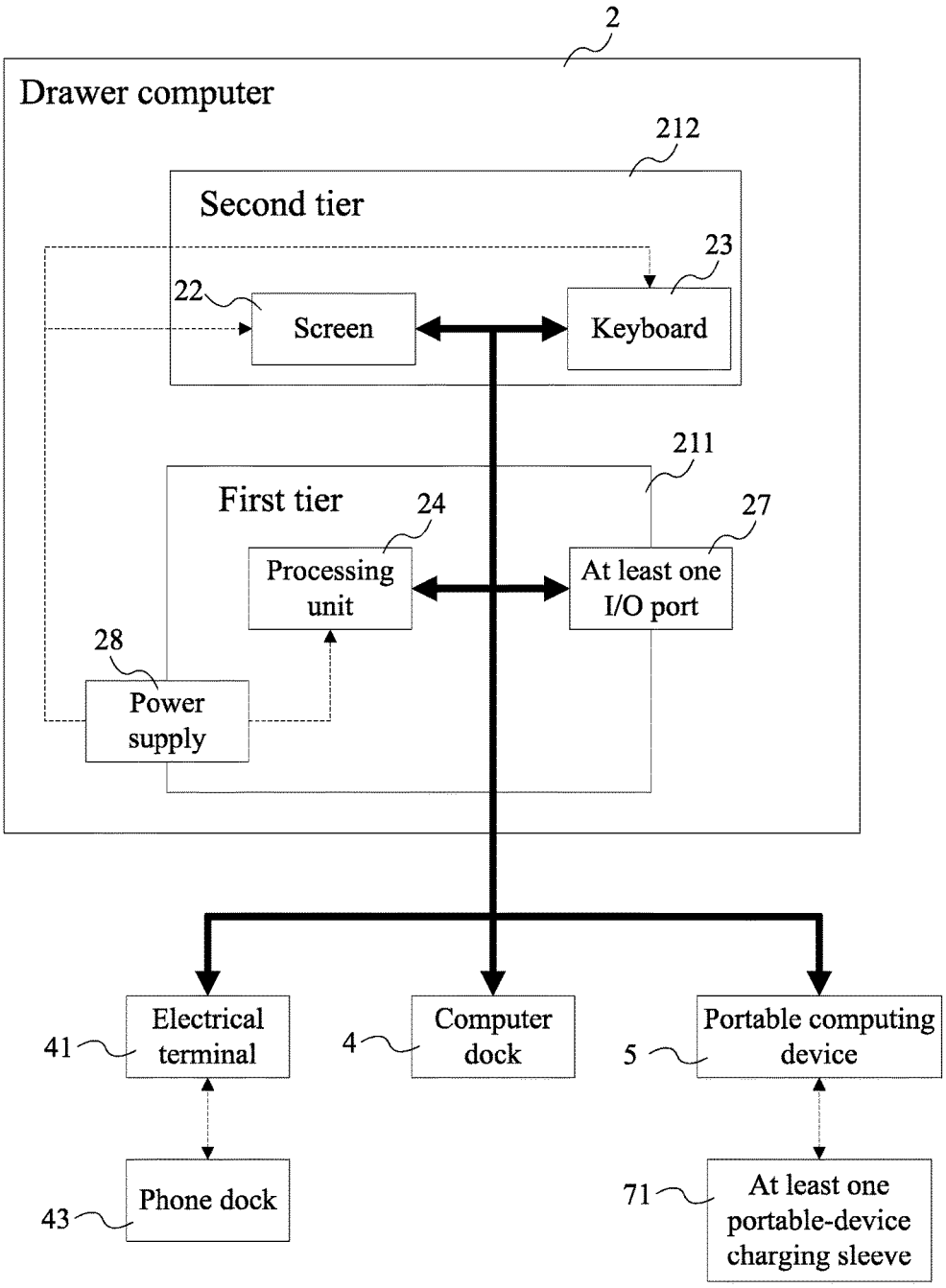
FIG. 12 is a block diagram of the electrical components of the present invention where bold lines indicate electronic connections and dashed lines indicate electrical connections.

As can be seen in FIG. 1 and FIG. 10, to further usability, the present invention comprises a computer dock 4. The computer dock 4 is a docking station that enables the user to securely mount a portable computer beneath the tabletop 12. Additionally, the present invention comprises at least one electrical terminal 41. The electrical terminal 41 is an electronic interface that enables the user to electronically connect portable computers to the drawer computer 2. The computer dock 4 is mounted beneath the table top so that the portable computer mounted thereon is maintained in a safe position and orientation. The electrical terminal 41 is integrated into the computer dock 4. Consequently, any portable computer that is mounted onto the computer dock 4 is placed into electronic communication with the electrical terminal 41. Furthermore, the electrical terminal 41 and the computer dock 4 are electronically connected to the drawer computer 2. As a result, the portable computer is electronically connected to the drawer computer 2. This connection enables the portable computer and the drawer computer 2 to share electrical power and electronic data.

As can be seen in FIG. 10, the computer dock 4 is ergonomically designed to increase usability and user comfort. As such, the present invention comprises a cup holder 42 and a phone dock 43. The cup holder 42 is a receptacle that is designed to hold cups. Additionally, the cup holder 42 is integrated into the computer dock 4 so that the user can secure store cups on the tabletop 12 while working. Likewise, the phone dock 43 is a receptacle into which the user places a phone. Furthermore, the phone dock 43 is integrated into to the computer dock 4. Consequently, the phone dock 43 functions as a storage container for the user's phone while working. The cup holder 42 is positioned offset from the electrical terminal 41 across the computer dock 4. Conversely, the phone dock 43 is positioned offset from the electrical terminal 41 across the computer dock 4, opposite to the cup holder 42. Thus positioned, the cup holder 42 and the phone dock 43 enable the user to have a swath of uninterrupted working area without limiting the comfort derived from using the present invention. The phone dock 43 functions as both a phone holder and a phone charger. To accomplish this, the phone dock 43 is electrically connected to the electrical terminal 41. Accordingly, the phone dock 43 is able to supply electrical power to an inserted phone.

As can be seen in FIG. 1 and FIG. 7 through FIG. 9, the Present invention is designed to be a multipurpose device that can be used in a variety of settings. To that end, the present invention, comprises a portable computing device 5 and a clamshell casing 6. The portable computing device 5 can be any mobile computing device including, but not limited to, a laptop or a tablet computer. The clamshell casing 6 is a rigid enclosure that is designed to be carried similarly to a briefcase. The portable computing device 5 is housed within the clamshell casing 6. Consequently, the user is only able to access the portable computing device 5 by opening the clamshell casing 6. Furthermore, the clamshell casing 6 functions as the exterior housing for the portable computing device 5. The clamshell casing 6 is detachably mounted onto the computer dock 4. Additionally, portable computing device 5 is electronically connected to drawer computer 2 through the computer dock 4. As a result, the user is able to mount the clamshell casing 6 onto the computer dock 4 while simultaneously electronically connecting the portable computing device 5 to the drawer computer 2.

Figure 7:
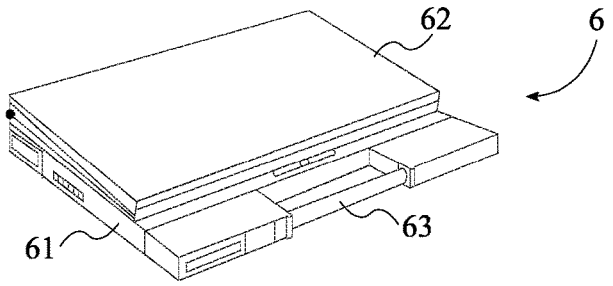
FIG. 7 is a perspective view of the clamshell casing in the closed configuration.
Figure 8:
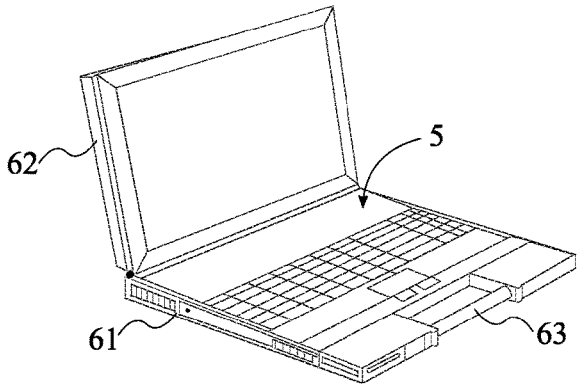
FIG. 8 is a perspective view of the clamshell casing in the opened configuration where the portable computing device is accessible.
Figure 9:
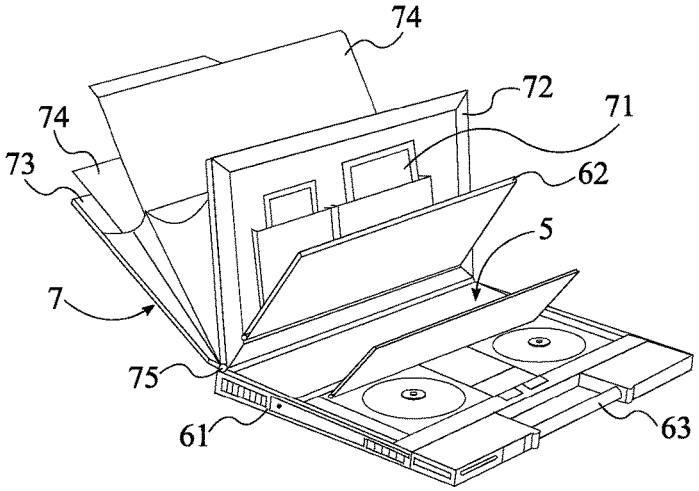
FIG. 9 is a perspective view of the clamshell casing and the detachable folio in the opened configuration.

As can be seen in FIG. 7 through FIG. 9, the clamshell casing 6 is designed to be a briefcase-like enclosure that can be opened to access an interior compartment. To accomplish this, the clamshell casing 6 comprises a base 61, a lid 62, and a handle 63. The lid 62 is hingedly connected to the base 61 so that the lid 62 and the base 61 of the clamshell casing 6 can be opened and closed in a clamshell motion. The handle 63 is adjacently connected to the base 61, opposite the hinged connection between the lid 62 and the base 61. Thus positioned, the handle 63 facilities carrying the clamshell casing 6 while in a closed configuration. Additionally, the portable computing device 5 being positioned in between the lid 62 and the base 61. Consequently, the portable computing device 5 is enveloped by the clamshell casing 6 and can only be accessed while the clamshell casing 6 is in an opened configuration.

As can be seen in FIG. 7 through FIG. 9, the present invention further comprises a detachable folio 7 that is used to add storage space to the clamshell casing 6. Additionally, the present invention comprises at least one charging device that is used to charge mobile devices including, but not limited to, smartphones and tablet computers. The detachable folio 7 is a multipage folio that can be used to store documents and personal items. To accomplish this, the detachable folio 7 comprises a front cover 72, a rear cover 73, a plurality of folders 74, and a spine 75. The front cover 72 and the rear cover 73 are rigid panels that are the outer pages of the detachable folio 7. The plurality of folders 74 forms the pages that are positioned between the front cover 72 and the rear cover 73 of the detachable folio 7. Additionally, front cover 72, the rear cover 73, and the plurality of folders 74 are hingedly connected along the spine 75. Moreover, the plurality of folder is positioned in between the front cover 72 and the rear cover 73. Consequently, the front cover 72, the rear cover 73 and the plurality of folders 74 are configured to function like a book with the front cover 72 and the rear cover 73 functioning analogous to the front and rear covers of a book. The front cover 72 is mounted onto the clamshell casing 6. As a result, the front cover 72 remains fixed, relative to the clamshell casing 6, while the rear cover 73 and the plurality of folders 74 are able to rotate about the spine 75. To charge mobile devices the portable-device charging sleeve 71 is connected onto a single folder from the plurality of folders 74. Thus positioned, the portable-device charging sleeve 71 is able to be discretely concealed while charging an inserted mobile device. Additionally, the portable-device charging sleeve 71 is electrically connected to the portable computing device 5 so that electrical power can be supplied to an inserted mobile device.

Although the invention has been explained in relation to its preferred embodiment, it is to be understood that many other possible modifications and variations can be made without departing from the spirit and scope of the invention as hereinafter claimed.

What is claimed is:

1. A multipurpose desk with an integrated computer system comprising:

a desk;

a drawer computer;

a roll up door;

the desk comprising a support structure, a tabletop, an antiballistic shell, a concealment cavity, a computer enclosure and at least one storage compartment;

the tabletop being connected onto the support structure;

the antiballistic shell being connected around a lateral surface of the support structure, adjacent to the tabletop;

the concealment cavity laterally traversing through the antiballistic shell into the support structure, adjacent to the tabletop;

the storage compartment being integrated into the support structure, adjacent to the concealment cavity;

the computer enclosure being integrated into the support structure, adjacent to the concealment cavity;

the storage compartment and the computer enclosure being positioned opposite to each other about the concealment cavity;

the drawer computer being slidably mounted within the computer enclosure;

the roll up door being mounted across the concealment cavity;

the roll up door comprising a plurality of panes, a first track and a second track;

the first track being connected along the support structure, adjacent to an opening of the concealment cavity;

the second track being connected along the support structure, adjacent to the opening of the concealment cavity;

the first track and the second track being positioned opposite to each other about the concealment cavity;

each of the plurality of panes being slidably mounted between the first track and the second track;

the plurality of panes being serially coupled to one another; and each of the plurality of panes being made from an antiballistic material.

2. The multipurpose desk with an integrated computer system as claimed in claim 1 comprising:

the drawer computer comprising a tiered housing, a screen, a keyboard and a processing unit;

the screen being hingedly connected to the tiered housing;

the keyboard being mounted onto the tiered housing, adjacent to the screen;

the processing unit being mounted within the tiered housing, offset from screen; and the screen and the keyboard being electronically connected to the processing unit.

3. The multipurpose desk with an integrated computer system as claimed in claim 2 comprising:

the tiered housing comprising a first tier and a second tier;

the first tier being slidably mounted onto the second tier;

the second tier being slidably engaged into the computer enclosure;

the screen being hingedly connected to the first tier;

the keyboard being mounted onto the first tier, opposite to the second tier; and the processing unit being housed within the second tier.

4. The multipurpose desk with an integrated computer system as claimed in claim 2 comprising:

a motor;

the motor being operatively integrated in between the tiered housing and the computer enclosure; and the motor being used to slide the tiered housing into and out of the computer enclosure.

5. The multipurpose desk with an integrated computer system as claimed in claim 2 comprising:

a locking mechanism;

the locking mechanism being operatively integrated in between the tiered housing and the computer enclosure; and the locking mechanism being used to secure the tiered housing within the computer enclosure.

6. The multipurpose desk with an integrated computer system as claimed in claim 2 comprising:

at least one input/output (I/O) port;

the I/O port being integrated into an exterior surface of the tiered housing; and the I/O port being electronically connected to the processing unit.

7. The multipurpose desk with an integrated computer system as claimed in claim 2 comprising:

a power supply; and the power supply being electrically connected to the processing unit, the screen and the keyboard.

8. The multipurpose desk with an integrated computer system as claimed in claim 1 comprising:

a computer dock;

at least one electrical terminal;

the computer dock being mounted beneath the tabletop;

the electrical terminal being integrated into the computer dock; and the electrical terminal and the computer dock being electronically connected to the drawer computer.

9. The multipurpose desk with an integrated computer system as claimed in claim 8 comprising:

a cup holder;

a phone dock;

the cup holder being integrated into the computer dock;

the phone dock being integrated into to the computer dock;

the cup holder being positioned offset from the electrical terminal across the computer dock;

the phone dock being positioned offset from the electrical terminal across the computer dock, opposite to the cup holder; and the phone dock being electrically connected to the electrical terminal.

10. The multipurpose desk with an integrated computer system as claimed in claim 1 comprising:

a computer dock;

a portable computing device;

a clamshell casing;

the computer dock being mounted beneath the tabletop;

the portable computing device being housed within the clamshell casing;

the clamshell casing being detachably mounted onto the computer dock; and the portable computing device being electronically connected to drawer computer through the computer dock.

11. The multipurpose desk with an integrated computer system as claimed in claim 10 comprising:

the clamshell casing comprising a base, a lid and a handle;

the lid being hingedly connected to the base;

the handle being adjacently connected to the base, opposite the hinged connection between the lid and the base; and the portable computing device being positioned in between the lid and the base.

12. The multipurpose desk with an integrated computer system as claimed in claim 10 comprising:

a detachable folio;

at least one portable-device charging sleeve;

the detachable folio comprising a front cover, a rear cover, a plurality of folders and a spine;

the front cover, the rear cover and the plurality of folders being hingedly connected along the spine;

the plurality of folder being positioned in between the front cover and the rear cover;

the front cover being mounted onto clamshell casing;

the portable-device charging sleeve being connected onto a single folder from the plurality of folders; and the portable-device charging sleeve being electrically connected to the portable computing device.

* * * * *